United States Patent [19]

Shadman et al.

[11] 4,329,844

[45] May 18, 1982

[54] DIESEL EXHAUST FILTER-INCINERATOR

[75] Inventors: Farhang Shadman, Tucson, Ariz.; Louis Hegedus, Grosse Pointe Woods, Mich.

[73] Assignee: General Motors Corporation, Detroit, Mich.

[21] Appl. No.: 150,309

[22] Filed: May 16, 1980

[51] Int. Cl.[3] ..... F01N 3/02

[52] U.S. Cl. ..... 60/311; 55/282; 55/441; 55/466; 55/523; 55/526

[58] Field of Search ..... 60/311; 55/DIG. 10, 55/DIG.30, 282, 441, 466, 523, 526

[56] References Cited

U.S. PATENT DOCUMENTS

| | | | |
|---|---|---|---|
| 3,295,919 | 1/1967 | Henderson | 60/298 |
| 3,910,770 | 10/1975 | Kobylinski | 60/301 |
| 4,015,959 | 4/1977 | Grote | 55/486 |
| 4,040,253 | 9/1977 | Dhugues | 60/303 |
| 4,054,417 | 10/1977 | Rosebrock | 60/311 |

FOREIGN PATENT DOCUMENTS

| | | | |
|---|---|---|---|
| 2856725 | 7/1979 | Fed. Rep. of Germany | 60/311 |

*Primary Examiner*—Douglas Hart
*Attorney, Agent, or Firm*—Robert J. Outland

[57] ABSTRACT

A diesel exhaust particulate filter contains a high temperature depth type filter material arranged in a reflexive path throughout which diesel particulates are collected from engine exhaust gases passed therethrough. Upstream and downstream portions of the filter flow path are disposed in heat exchange relation. Upon heating of the incoming gases to the incineration temperature of collected particulates, the heat of combustion in the downstream portion will be partially transferred to the upstream portion, providing more even temperature levels and improving balance of the incineration process.

3 Claims, 5 Drawing Figures

DIESEL EXHAUST FILTER-INCINERATOR

TECHNICAL FIELD

This invention relates to diesel engine exhaust particulate filters and, more particularly, to incineration cleanable filter elements for the collection of combustible particulates from diesel engine exhaust gases.

BACKGROUND

One technique that is currently under consideration for the reduction of particulate emissions from diesel engines is exhaust filtration. Various types of filter devices are being studied which could provide high filtration efficiencies with low back pressures.

Some filters also have potential for being cleaned, or regenerated, by incineration of the collected particulates during operation of a vehicle. Depth type filters formed from high temperature materials of various types, particularly fibrous filters, are among those which have been considered for exhaust filtration and have potential for regeneration during operation. Such regeneration may be accomplished by periodically raising the temperature of the engine exhaust gases through means such as engine throttling or auxiliary heating devices.

Our study of the process of thermal regeneration of depth type fibrous filters has shown that three stages are involved in the process: a preignition stage, a rapid combustion stage, and a slow combustion stage.

During the preignition stage, the interaction between the heat generation rate and the heat loss rate produces temperature peaks in the gas and solids which develop and increase in magnitude. When the temperatures are sufficiently high, ignition and rapid combustion being around the temperature peaks.

Shortly after ignition, two combustion fronts are formed which move in opposite directions downstream and upstream. The downstream front propagates rapidly and grows with time. In some cases temperatures at this front may exceed the melting point of fibers in the filter material and cause damage to the filter. The upstream combustion front moves slowly against the direction of gas flow and decays with time.

When the downstream front has burned all the particulate deposit in its path, regeneration continues with only the upstream front operative. This causes a final slow stage of regeneration which decelerates gradually. Thus, regeneration of the inlet section of fibrous depth type filters is relatively difficult and slow.

SUMMARY OF THE INVENTION

The present invention provides improved arrangements for depth type incineration cleanable filters. These yield overall increases in the rates of complete regeneration while, at the same time, lowering the temperatures of the high temperature peaks, thereby reducing the possibility of damage to the filter elements.

The invention utilizes a reflexive gas flow path through the filter medium having upstream and downstream portions arranged in heat exchange relation with one another. During regeneration, heat from the high temperatures developed through movement of the flame front in the downstream portion is transferred through a separating wall to the adjacent upstream portion. This increases the temperature of the latter and aids the spread of combustion in the cooler upstream portion. At the same time, temperatures in the hotter downstream portion are reduced, protecting the filter material from overheating and balancing out, to some extent, the rate of incineration in the upstream and downstream portions.

These and other features and advantages of the invention will be more fully understood from the following description of certain preferred embodiments, taken together with the accompanying drawing.

BEST MODE DESCRIPTION

Figure 1:
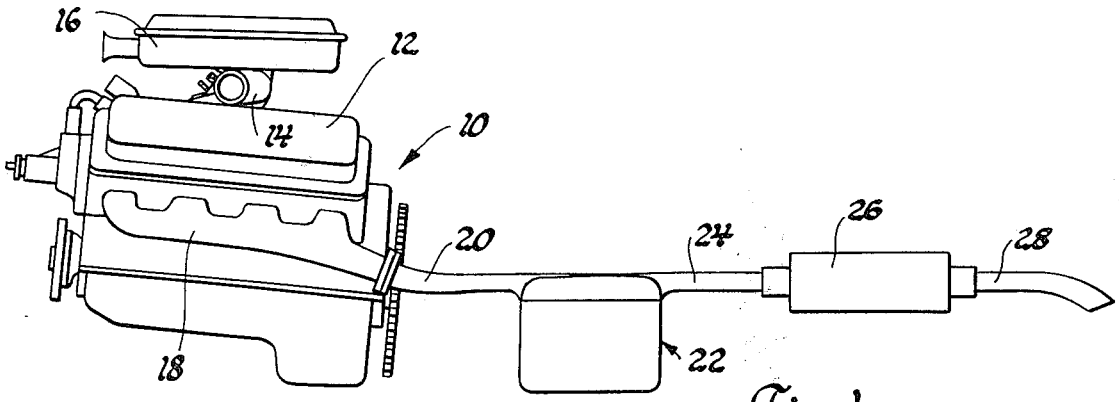
FIG. 1 is a side elevational view of a diesel engine and exhaust system as installed in a vehicle and including filter means in accordance with the invention.

Referring now to the drawing in detail, numeral 10 generally indicates a diesel engine and exhaust system arranged for installation in an automotive vehicle. System 10 includes a diesel engine 12 having air intake means 14 including an air filter 16 and exhaust gas handling means including an exhaust manifold 18.

The exhaust manifold 18 connects through an exhaust pipe 20 with a reflex exhaust particulate filter 22 formed in accordance with the principles of the invention. The filter 22, in turn, connects through an intermediate pipe 24 with a muffler 26 and tailpipe 28 that is open to atmosphere.

Figure 2:
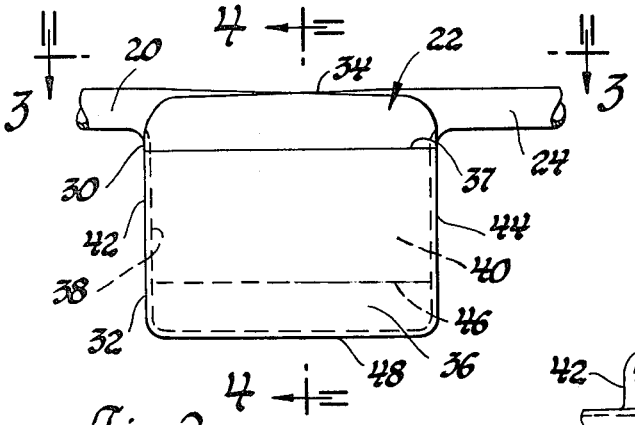
FIG. 2 is an enlarged side view of the reflex filter installed in the system of FIG. 1.
Figure 3:
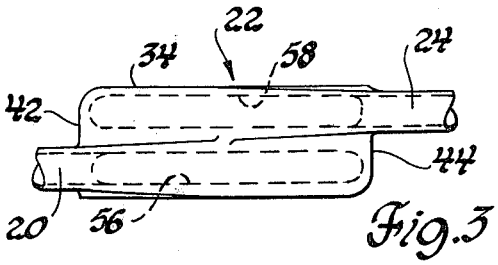
FIG. 3 is a top view of the reflex filter as viewed from the plane indicated by the line 3—3 of FIG. 2.
Figure 4:
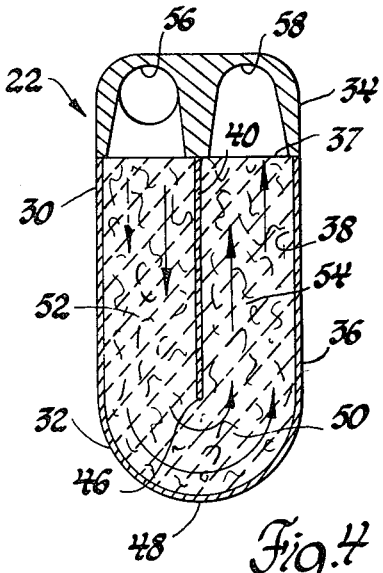
FIG. 4 is a cross-sectional view of the reflex filter of FIGS. 2 and 3, as viewed from the plane indicated by the line 4—4 of FIG. 2.

The construction of the reflex exhaust filter is best shown in FIGS. 2 through 4 to include a housing 30 comprising a filter body 32 and an attached cover 34.

The filter body 32 includes an outer shell 36 open at the top 37 but otherwise enclosing a relatively narrow but long and deep filter chamber 38 containing a dividing wall 40. The wall 40 extends longitudinally between the ends 42 and 44 of the shell 36 and vertically from its open top 37 downwardly to a position 46 located at a distance above the bottom 48 approximately equal to half the width of the filter body.

Within the filter chamber 38, on both sides of and below the dividing wall 40, there is provided a compacted fibrous depth type filter medium 50. The filter medium may be formed of any suitable high temperature fibrous material, such as high temperature steel wire, ceramic fiber, or the like, compacted sufficiently to provide efficient filtration of exhaust particulates from the exhaust gases of the diesel engine.

The filled filter chamber 38 defines a reflexive flow path having upstream and downstream portions 52, 54, respectively, separated from one another by the dividing wall 40 and confined by the outer shell 36. The dividing wall 40 and outer shell 36 are preferably formed of high temperature materials having good heat transfer capability such as, for example, high temperature steel or other suitable materials.

The cover 34, which closes the open top 37 of the filter body shell defines laterally spaced inlet and outlet headers 56 and 58 which respectively connect with the exhaust pipe 20 and the intermediate pipe 24. The inlet header 56 receives exhaust gases from the diesel engine 12 and directs them into the upstream portion 52 of the filter flow path, while the outlet header 58 receives filtered exhaust gases from the downstream portion 54 of the filter flow path and conducts them to the intermediate pipe 24 of the exhaust system.

In order to provide for incineration of collected particulates in the exhaust filter, the engine or the exhaust system is preferably provided with some means for increasing the temperature of exhaust gases delivered to the filter to a point where ignition of the particulates will take place. While any suitable means may be employed for this purpose, a preferred arrangement involves periodic throttling of the induction system. A system of this type is described, for example, in the copending U.S. patent application Ser. No. 952,710 filed Oct. 19, 1978 and assigned to the assignee of the present invention.

In operation, exhaust gases from the diesel engine are passed through the exhaust pipe 20 into the filter 22 where they flow from the inlet header 56 down through the upstream portion 52 of the filter flow path and up through the downstream portion 54, leaving particulates filtered out of the exhaust gases lodged at various points along the flow path. The filtered exhaust gases pass through the outlet header 58, intermediate pipe 24, muffler 26, and tailpipe 28 to atmosphere.

At periodic intervals, or at any time when the filter medium becomes unduly restricted by the collection of particulates, the temperature of the exhaust gas entering the filter is increased as necessary by throttling of the engine intake, or otherwise, to a level at which incineration of the collected particulates begins. Typically, low level oxidation of the collected combustible particulates, which are largely carbonaceous in nature but which may also include liquified heavy hydrocarbons, causes increasing temperatures until at some point in the filter medium, probably near the beginning of the downstream portion 54, the ignition temperature of the particulates will be reached. Following this occurrence, combustion spreads rapidly in the direction of gas flow, upwardly through the downstream portion 54 of the gas flow path, raising the temperature in the downstream portion and burning off the collected particulates along a rapidly moving combustion front. At the same time, a relatively slower moving combustion front moves in an upstream direction against the flow of gases into the upstream portion 52 of the gas flow path.

As combustion proceeds, heat developed in the faster burning downstream portion 54 is partly dissipated through the outer shell 36 and partly transferred through the dividing wall 40 to the upstream flow path portion 52, thereby limiting the maximum combustion temperature reached in the downstream portion 54 and protecting the filter medium against damage due to excessive temperature. At the same time, the transfer of heat into the upstream portion 52 increases the rate of travel of the upstream-moving combustion front and thereby accelerates the completion of incineration of particulates in the upstream gas flow path portion 52.

At some time during or after completion of the incineration process, the exhaust gas heating means (e.g. throttle) is returned to its normal condition and the system operation is returned to normal with exhaust particulates being collected within the filter medium.

Figure 5:
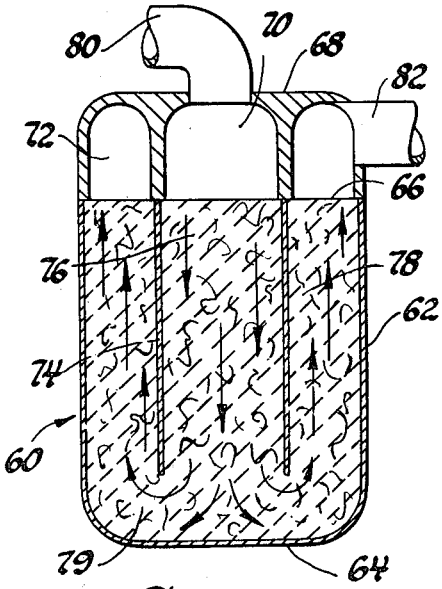
FIG. 5 is a cross-sectional view of an alternative embodiment of reflex filter formed in accordance with the principles of the invention.

FIG. 5 illustrates one of numerous possible alternative embodiments of reflex exhaust particulate filter arrangements capable of being formed within the scope of the invention. The filter 60 of FIG. 5 includes a cylindrical cannister 62 having a closed bottom 64 and open top 66 which is closed by a cover 68, defining a central inlet header 70 and a surrounding outlet header 72. A cylindrical dividing wall 74, extending within the cannister 62 from the open top 66 to a level above the closed bottom 64, defines within the filter 60 a reflective flow path which includes a central upstream portion 76 and a surrounding annular downstream portion 78. Both the upstream and downstream portions are filled with a suitable depth type filter medium 79, preferably of the high temperature fibrous type, as previously described. An inlet conduit 80 connects with the inlet header 70 to deliver exhaust gases thereto, while an exhaust conduit 82 extends from the outlet header 72 to carry away filtered exhaust gases.

The operation of the embodiment of FIG. 5 is similar to that previously described. Exhaust gases directed into the inlet header 70 pass through the reflex flow path upstream and downstream portions 76, 78, to the outlet header 72, leaving particulates distributed throughout the filter medium. Subsequently, upon heating to incineration temperature, the relatively rapid combustion of particulates in the downstream flow path portion 78 generates heat which is transmitted partly through the dividing wall 74 to the upstream flow path portion 76 where it accelerates the combustion of particulates therein. At the same time, additional heat is carried away through the walls of the cannister 62, thereby limiting combustion temperatures reached in the downstream flow path portion 78 to levels capable of being withstood by the fibrous filter medium.

While the invention has been disclosed by reference to certain specific embodiments chosen for purposes of illustration, it should be understood that numerous changes could be made within the scope of the inventive concepts described. Accordingly, it is intended that the invention not be limited except by the language of the following claims.

The embodiments of the invention for which an exclusive property or privilege is claimed are defined as follows:

1. A diesel engine exhaust particulate filter comprising a housing defining a filter chamber having an inlet and an outlet, said housing having heat transmitting wall means in said chamber defining therein a reflexive flow path from the inlet to the outlet, said flow path having separate adjacent upstream and downstream portions in heat exchange relation to one another through said wall means, said flow path containing a depth type filter medium in said upstream and downstream portions and capable of collecting along its length particulates from diesel exhaust gases passed therethrough, said filter medium being further capable of withstanding temperatures adequate to incinerate the collected particulates therein, whereby upon heating collected particulates to incineration temperature during operation with an associated diesel engine, heat transfer through the wall means between the upstream and downstream portions of the filter chamber flow path is operative to moderate combustion temperatures in the hotter downstream portion and to promote more rapid incineration in the cooler upstream portion.

2. A diesel engine exhaust particulate filter comprising a housing defining a filter chamber having an inlet and an outlet, said housing having metal heat transmitting wall means in said chamber defining therein a reflexive flow path from the inlet to the outlet, said flow path having separate adjacent upstream and downstream portions in heat exchange relation to one another through said wall means, said flow path containing a fibrous depth type filter medium in said upstream and downstream portions and capable of collecting along its length particulates from diesel exhaust gases passed therethrough, said filter medium being further capable of withstanding temperatures adequate to incinerate the collected particulates therein, whereby upon heating collected particulates to incineration temperature during operation with an associated diesel engine, heat-transfer through the wall means between the upstream and downstream portions of the filter chamber flow path is operative to moderate combustion temperatures in the hotter downstream portion and to promote more rapid incineration in the cooler upstream portion.

3. A filter as defined in either of claims 1 or 2 wherein the reflexive flow path of said filter chamber is arranged so that said downstream portion is bordered by an outside wall as well as said dividing wall, whereby some of the heat generated in the downstream portion during particulate incineration is dissipated externally of the filter, further limiting the maximum temperature levels reached in said downstream portion.

* * * * *